United States Patent [19]

Enkelmann

[11] Patent Number: 4,851,815

[45] Date of Patent: Jul. 25, 1989

[54] DEVICE FOR THE MONITORING OF OBJECTS AND/OR PERSONS

[75] Inventor: Thomas Enkelmann, Bremen, Fed. Rep. of Germany

[73] Assignee: Thomas Enkelmann Computer, Bremen, Fed. Rep. of Germany

[21] Appl. No.: 159,132

[22] Filed: Feb. 23, 1988

[30] Foreign Application Priority Data

Oct. 7, 1987 [DE] Fed. Rep. of Germany ..... 3733808

[51] Int. Cl.[4] ..... G08B 13/14

[52] U.S. Cl. ..... 340/571; 340/572

[58] Field of Search ..... 340/573, 572, 571, 539, 340/568

[56] References Cited

U.S. PATENT DOCUMENTS 4,573,042 2/1986 Boyd et al. ..... 340/539

FOREIGN PATENT DOCUMENTS 2181326 4/1987 United Kingdom ..... 340/572

8704282 7/1987 World Int. Prop. O. ..... 340/572

*Primary Examiner*—Jerry W. Myracle

*Attorney, Agent, or Firm*—Sughrue, Mion, Zinn Macpeak & Seas

[57] ABSTRACT

A device for the monitoring of objects and/or persons is described which comprises an RF transmitter (10) and a security tag (15) with a casing for accommodating an electronic circuit. The electronic circuit contains a battery and an alarm circuit (30). An alarm is triggered when an electrically conductive security element (14) for attaching the security tag (15) to the object or to the person is severed or when an external RF field generated by the RF transmitter (10) has a defined state. The RF transmitter (10) is here designed with an encoder (11) for coding the RF signal, while in the electronic circuit of the security tag (15) a decoder (20) is provided which outputs an alarm signal to the alarm circuit (30) to trigger an alarm when a defined information content of the coded RF signal is present.

42 Claims, 4 Drawing Sheets

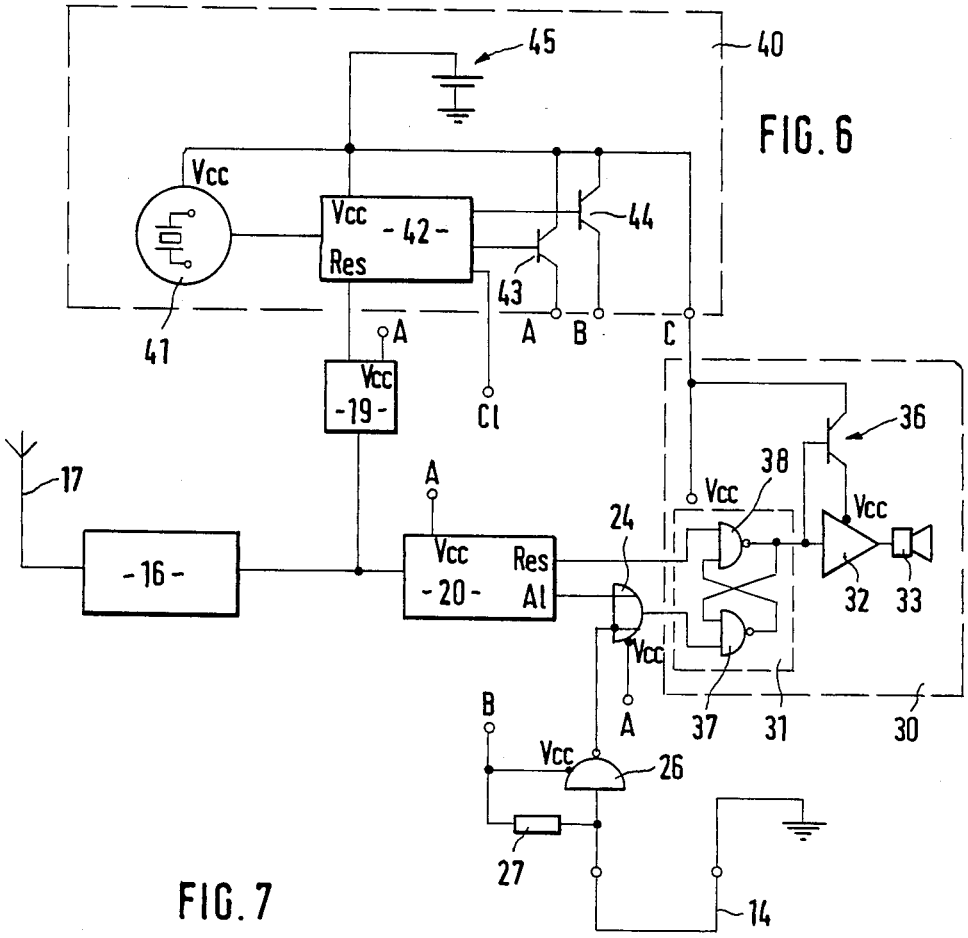
FIG. 6
FIG. 7
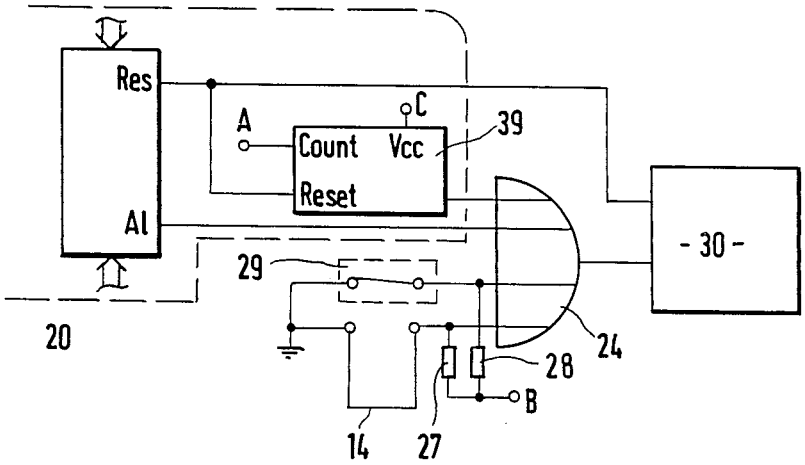

DEVICE FOR THE MONITORING OF OBJECTS AND/OR PERSONS

BACKGROUND OF THE INVENTION

The invention relates to a device for the monitoring of objects and/or persons according to the preamble of Patent Claim 1.

For safeguarding of objects from unauthorized removal, so-called resonator tags are known which are attached to the object in question to be safeguarded and which contain a resonant circuit that, when the object is taken through a "gate", causes interference at an RF field generated there, which in turn triggers an alarm. If, however, a shoplifter succeeds in removing the tag from the object to be safeguarded before going through the gate, the theft cannot be detected. In addition, it is a pre-requisite for resonator tags of this kind, for each exit from the area (shop) to be monitored to have such a gate, which, due to the high costs of the gates, is economically unjustifiable, for example, for larger department stores or even factory premises.

A device of the type mentioned at the start is known from German Offenlegungsschrift No. 3,119,112, which itself outputs an (acoustic) alarm, either when the security tag is removed from the object to be safeguarded or when the tag is taken out of an area in which, by means of an RF transmitter, an RF field is generated which is detected by an RF receiver arranged in the tag and used to suppress an alarm. A technically minded shoplifter can however very easily carry a transmitter (emitting over a broadband) and remove the "safeguarded" object complete with the security tag kept silent by means of his or her transmitter. If, moreover, the known device is to be used to monitor not objects but persons,—e.g. visitors to a larger plant who should only have access to certain areas—, then this is only possible to a limited extent, since at best individualization of the security tags (permitted/forbidden areas are not the same for each visitor) is possible using matched RF circuits, which again leads to economically unjustifiable high costs for the security tags.

SUMMARY OF THE INVENTION

Starting from the abovementioned prior art, it is the object of the present invention to further develop a device of the type mentioned at the start in such a manner that a greater variety of applications is achieved while at the same time enhancing the attainable security.

This object is achieved in the device mentioned at the start in that the RF transmitter is designed to emit a coded RF signal, and that the electronic circuit comprises a coder which outputs an alarm signal to the alarm circuit to trigger an alarm when a defined information content of the coded RF signal is present.

This device design firstly ensures an increased immunity to interference in comparison to the conventional system of the type mentioned at the start which always outputs an acoustic alarm when it is taken out of the area in which an uncoded RF field is generated. It is namely now no longer possible even for fairly technically minded long-fingered individuals to keep the device silent with the aid of a simple transmitter, since an alarm sounds when an uncoded or incorrectly coded RF signal is present just as when there is no RF signal present at all. If the device is designed so that an alarm is also output when a particular signal is present, this also increases the immunity to interference from foreign influences considerably. For example, it can no longer happen that all the objects in a toy department of a department store provided with the devices sound an alarm when a remote-controlled toy car is being demonstrated to a customer.

If the device according to the invention is used to monitor persons in the form of a "visitor tag" or "identification tag", the visitor can be "individualized" on the basis of the coding. If the device is designed here so that it sounds an alarm when it receives a signal with a defined code, then transmitters that emit this particular code can be set up in those areas to which the visitor is not to have access. Various "levels", for example, are easily conceivable here, which can be defined overlapping each other within a factory premise using RF transmitters which emit different kinds of codes. Depending on classification, the user then receives a device with a decoder which sounds an alarm when a particular, if necessary even different code (in OR combination) is present. Furthermore, this design and use of the device as a visitor tag makes it not only possible to monitor the visitor, but also, for example, to automatically "pilot" the visitor, for example, through a larger factory premises which has been divided up into "grid squares" by transmitters having different codes from each other.

This device design can also be used advantageously to protect against theft. Taking a department store with three storeys as an example, a particular code can then be assigned, for example, to each storey, and all the security tags with which the objects on this storey are provided are set to this code. The coders of the RF transmitters are then set so that although each storey is provided with transmitters which set up the corresponding RF fields, the code which triggers an alarm is not emitted on the corresponding storey. Consequently an alarm is already triggered if a protected object is moved from one storey to another. Naturally the same applies in the case where an RF field has to be present with corresponding coding to keep a security tag silent.

To increase security, it is advantageous if the two above described alternatives are combined using an AND combination, so that an alarm is always triggered when the protected object is either taken out of the RF field which is keeping the alarm silent or taken into a field which triggers an alarm.

An expedient design of the device is that a once triggered alarm sounds until the device receives an RF signal modulated with a second code which switches off the alarm. The associated RF transmitters are preferably designed as hand-held devices which are carried, for example, by every store detective.

The security of the devices discussed here is further determined by the life of the batteries used. Since the casings of the devices may naturally not exceed certain maximum dimensions, and also the costs for larger batteries are greater than for smaller batteries, only a limited operating time of the devices is possible. After the battery is exhausted an alarm is no longer triggered. If the operating life of the devices with one set of batteries is only very short, then the statistical probability for a used battery is higher than for devices with a longer operating time. The solution to this problem is suggested according to the invention in that the device is provided with a timing circuit which outputs at defined intervals, e.g. once per second, switch-on signals which "wake up" the other active parts of the device by switching on their power supply, while in the intervals between these signals these active parts "sleep". The length of the "awake phase" is preferably selected longer for the RF alarm part than for the monitoring of the security element, since during the "awake" phase at least one complete code signal, consisting of several bits, must be received in any case, while a single bit is sufficient so to speak for the monitoring of the conductive security element. In this manner the device can be operated, for example, with a 1:9 ratio between active and "sleeping" state which leads to considerable savings for power and hence to a considerable extension of the life of the battery. In addition, a clock signal can be generated for the decoder via the timing circuit if the timing circuit (which preferably contains a quartz oscillator) is synchronized with the receive RF code signals.

The alarm emitted can be either an acoustic signal or an RF signal which outputs an alarm, for example, to a transmitter carried by the store detective. It is advantageous here if the emitted RF signal is coded so that this code can then be selected specifically, for example for the object provided with the security tag. The store detective then knows, for example, that a protected object has just been removed from the jewellery department or leather goods department or . . . . Of course, it is also possible to combine both types of alarms.

Further essential features of the invention are stated in the following description of preferred embodiments of the invention, which are described in more detail with reference to drawings in the form of schematic block circuit diagrams.

DESCRIPTION OF THE DRAWINGS

FIG. 6 shows a further preferred embodiment of the invention with timing circuit, and FIG. 7 shows a preferred embodiment of the decoder and of further security elements.

DETAILED DESCRIPTION OF PREFERRED EMBODIMENTS

Figure 1:
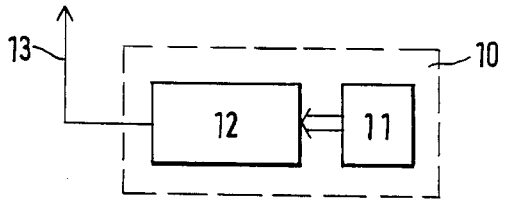
FIG. 1 shows a first preferred embodiment of the device with transmitter and receiver.
Figure 1:
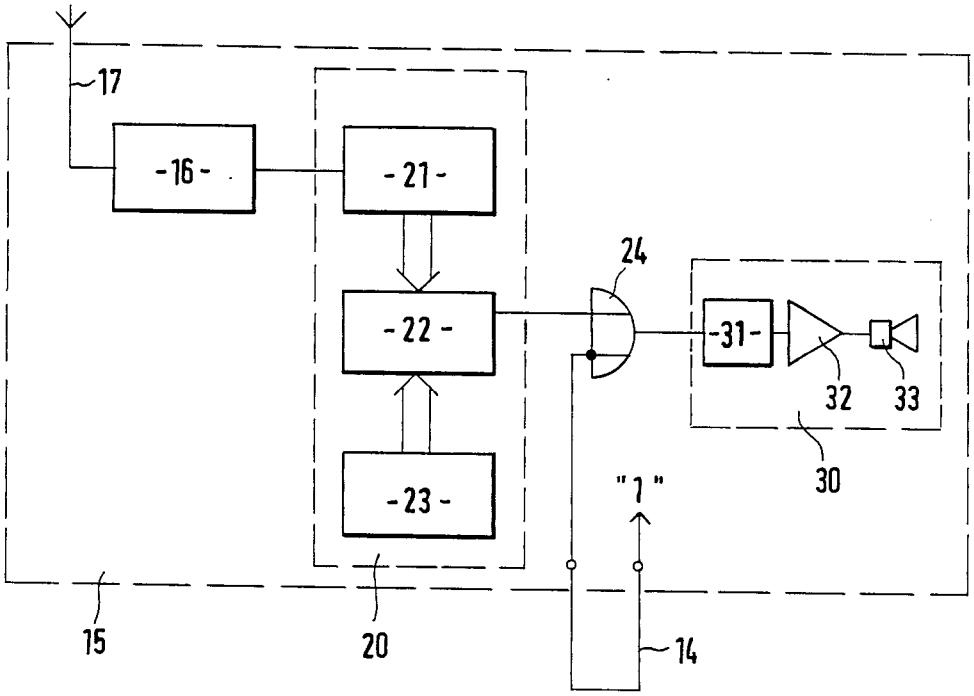

As illustrated in FIG. 1, the device for monitoring comprises an RF transmitter 10 which codes the RF signals of a transmitter 12 emitted from an aerial 13, using a coder 11.

The coded RF signals are received by the security tag, which is indicated in FIG. 1 with a dashed line and is denoted with the reference number 15, via an aerial 17, through which they arrive at an RF receiver 16 which converts the signals via passive components (LC parallel resonant circuit connected subsequently to a demodulator and finally to a pulse shaper) into signals which are "understood" by digital circuits. The digital signals received in this manner reach the decoder 20, to be precise first of all a serial/parallel transducer 21 there which always reads in a complete code word. After it has been read in, the stored code word is passed on in parallel to a comparator 22 which compares this code word with a code word supplied to it via a coding switch 23. The compared signal from the comparator 22 ("1" where the code words match, "0" where they are different) is led to an input of an OR gate 24. The other, inverting input of the OR gate 24 is led via a security element 14, a wire, to a logical "1". The security tag 15 is attached to the object to be protected with the aid of the security element 14.

The output of the OR gate 24 is led to an alarm circuit 30 via the input of an alarm memory 31 which is designed in the arrangement illustrated in FIG. 1 preferably as a retriggerable monoflop with a long output pulse duration. The output of the alarm memory 31 is led to the input of a tone generator 32 which at the same time contains a driver that drives an electroacoustic transducer 33 (preferably a piezoelectroacoustic transducer). The arrangement here is such that a tone with a defined sound is output when a output signal is present at the alarm memory 31.

The way this arrangement functions is such that the alarm signal sounds when either an RF signal is received which is modulated with a code that matches the code set in the coding switch 23, the output of the OR gate 24 reaches a high level and hence the tone generator 32 is driven via the alarm memory 31 and an acoustic alarm is sounded, or when the security element 14 is severed and the logical "1" no longer lies on the (inverting) input of the OR gate 24.

Figure 2:
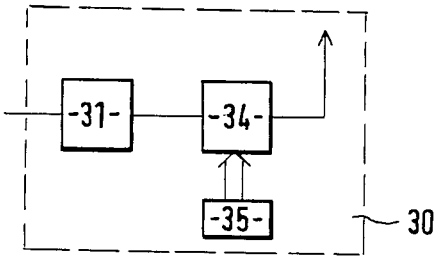
FIG. 2 shows a preferred embodiment of the alarm circuit from FIG. 1.

In a further preferred embodiment of the invention, instead of (or parallel to) the acoustic alarm circuit 30 of FIG. 1, an RF alarm circuit 30 (FIG. 2) is provided where the output of the alarm memory 31 activates an RF alarm transmitter 34 which outputs a coded RF signal that can be set via an RF alarm coder 35. This RF signal can be received and identified in an alarm receiver (not shown).

The coding switch 23 and the coders 11 and 35 are preferably designed to be at least partially adjustable so that at least each customer receives devices with a special code. Furthermore, this enables, as outlined at the start, tags 15 to be produced for specific goods or people without necessitating large-scale conversions or technical construction changes.

In the following, a further preferred embodiment of the invention will be presented with reference to FIG. 3. Here (as also in all subsequent explanations), already described components having the same function are denoted with the same reference numbers and are not described again.

Figure 3:
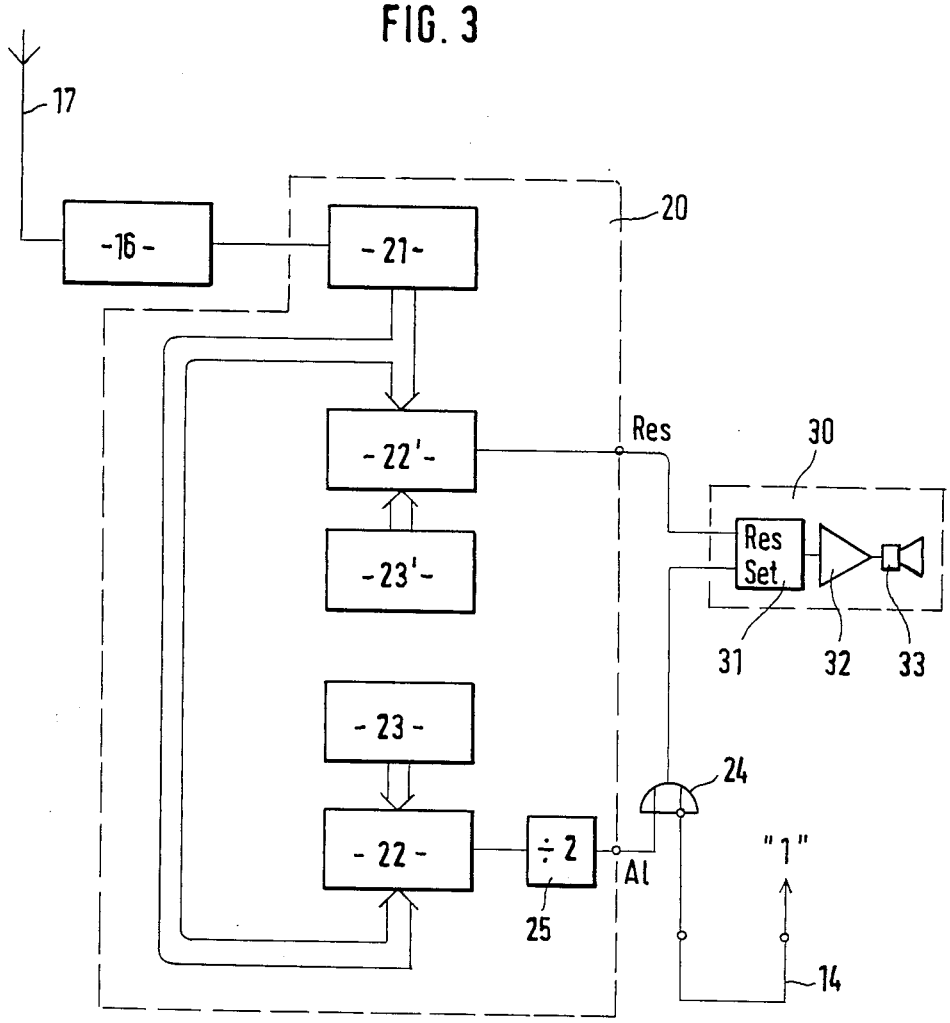
FIG. 3 shows a second preferred embodiment of the circuit located in the security tag.

A difference between the embodiment according to FIG. 3 and that of FIG. 1 lies in that the digital words stored in the serial/parallel transducer 21 are led both to the comparator 22 with coding switch 23 to trigger an alarm as well as to a further comparator 22' with a further coding switch 23'. The alarm circuit 30 differs from the alarm circuit 30 described with reference to FIG. 1 by a different embodiment of the alarm memory 31. The activation input Set of this alarm memory 31 is connected just as before to the output of the OR gate 24. The alarm memory 31 also has however a clear input Res which is connected to a corresponding output terminal, denoted Res in FIG. 3, of the further comparator 22' and which can be used to stop an already triggered alarm. The clear code (which is stored in the coding switch 23') is transmitted from a hand-held transmitter (not shown), carried, for example, by the store detective.

A further difference between the embodiment of the invention illustrated in FIG. 3 and that of FIG. 1 lies in the fact that a divider 25, which divides by two in the embodiment illustrated in FIG. 3, is connected after the comparator 22. This divider 25 now ensures that a signal is only present at the terminal A1 of the decoder 20 that triggers an alarm if the alarm code is detected twice. This provides an increased security from false alarms, whereby the division ratio can of course be increased to increase the redundancy and hence enhance the immunity from interference. In addition, in a preferred embodiment not shown here, a divider of this kind is also connected after a further comparator 22'.

Figure 4:
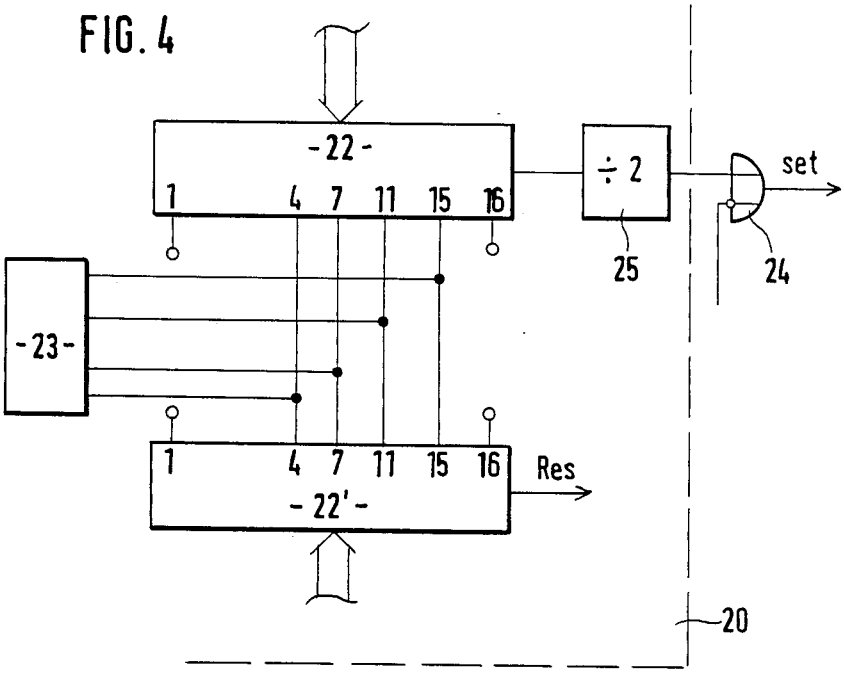
FIG. 4 shows a preferred embodiment of the coder.

Greater ease of construction can be achieved by using —as shown in FIG. 4—a single coding switch 23 for the first comparator 22 and the second comparator 22' (for resetting), so that when the alarm code is set specifically for the customer, the clear code can also be changed specifically for the customer. Moreover, the arrangement is simplified by the fact that only one part of the information can be set in both the alarm code and in the clear code, which is achieved in the embodiment of the invention illustrated in FIG. 4 by leading only the bits 4, 7, 11 and 15 to the (4-digit) coding switch 23, while the remaining ones of the total 16 bits lie on defined, subsequently unalterable logical levels. To reduce costs, the coding switches 23 can then be designed in the form of shortcircuit connectors in a manner known per se.

In the following, with reference to FIG. 5, a preferred embodiment of the security element is described with which the tag is attached to an object (a person). In this embodiment of the invention, a pull-up resistor 27 is provided between the input of an inverter 26 and the positive logical level (cf. Vcc), whereby the output of the inverter 26 lies on an input of the OR gate 24. The input of the inverter 26 lies further via the security element 14 on one end of an inductor 18 (Ferrocup), whose other terminal lies on chassis. If the security element 14 is severed, the input of the inverter 26 is pulled to a positive level so that a zero lies at the output of the inverter 26 and an alarm is output (via the inverting input of the OR gate 24).

Figure 5:
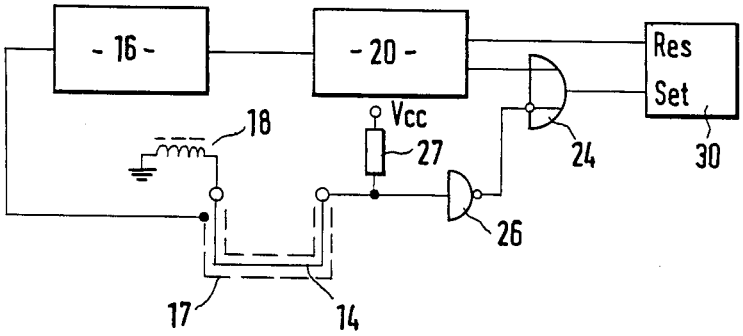
FIG. 5 shows a preferred embodiment of the invention with regard to the RF receiving aerial.

In addition, in the embodiment of the invention illustrated in FIG. 5, the security element is designed as a coaxial cable, the outer jacket 17 of which is led to the aerial input of the RF receiver 16. A short circuit of the received RF power is avoided by the inductor 18. Furthermore, this arrangement ensures that the (technically minded) light-fingered individual does not simply separate the aerial from the security tag in order to prevent an RF alarm being triggered. A two-core lead (preferably with little spacing between the cores) can of course also be used here, which similarly has the advantage that a relatively long aerial can be produced in a mechanically simple manner.

In the following, with reference to FIG. 6, a further, particularly preferred, embodiment of the invention is described which differs from the previously described embodiments firstly in that the alarm memory 31 comprises two crosswise coupled NAND latches 37, 38, so that once an alarm has been triggered it remains until a reset signal is output to the Res terminal of the decoder 20. Furthermore, in the embodiment of the invention illustrated in FIG. 6, a timing circuit 40 is provided which contains a quartz oscillator 41 with a subsequent divider 42. The reset input of the divider 42 is led via a synchronization circuit 19 to the output of the RF receiver 16 so that the timing circuit 40 is synchronized with the code sent when a coded RF signal is received.

The timing circuit 40 generates a clock pulse which is led to the decoder 20 in a manner known per se. In addition, via the counter 42, two electronic switches (FET) 43 and 44 are driven which lead the output voltage of the battery 45, for example once every second for defined intervals, to outputs A and B of the timing circuit 40. In the embodiment of the invention illustrated in FIG. 6, the battery voltage lies at point A longer than at point B.

The supply connections Vcc of the components provided in the timing circuit 40 are connected permanently to the battery 45 just like the power supply input Vcc of the alarm memory 31. The power supply input Vcc of the tone generator/driver 32 is led via an FET 36 to the continuous power supply, the gate connection of which lies at the output of the alarm memory 31. If an alarm is triggered therefore, the tone generator/driver 32 is supplied with power, otherwise it is disconnected from the battery 45.

The power supply input Vcc of the decoder 20 is connected to the terminal A of the timing pulse generator 40, as is also that of the OR gate 24. The pull-up resistor 27 lies, just as the power supply terminal of the inverter 26, on the point B. As a result of this, the power supply for the active components of the arrangement are only ever switched on at intervals (e.g. once every second) for the minimum period of time necessary to detect an alarm signal or a severance of the security element 14.

In the preferred embodiment of the invention illustrated in FIG. 7, besides the security element 14, a further switch 29 is provided in an arrangement otherwise the same as the security element 14, whereby another pull-up resistor 28 is provided here. The switch 29 is arranged in the casing (not shown) in such a manner that it is closed when the casing is also closed. If a light-fingered individual opens the casing (for example to remove the battery), the alarm is set off.

In this preferred embodiment of the invention, a counter 39 is further provided, the reset input of which is connected to the Res terminal of the decoder 20 (for example according to FIGS. 3 or 4) and the counting input (Count) of which lies on the point A of the timing circuit 40. The supply terminal Vcc is permanently connected to the battery 45. The output of the counter 39, where a logical "1" appears when the counter exceeds the limit, is placed at a further input of the OR gate 24. This arrangement functions in such a manner that the counter is incremented by 1 each time the arrangement is "woken up", that is when all active components are supplied with power. Each time a clear code is transmitted when the circuit is activated, the counter 39 is reset, therefore if a sufficient number of clear codes are present it can never expire and trigger an alarm. However, as soon as the clear code, in accordance with the counter construction, has not been received for a defined number of activation phases, the alarm is triggered. If the counter 39 is designed so that it can only count to 2, then this corresponds to an increase in redundancy as achieved by the counter 25 according to FIG. 3. In this embodiment of the invention, therefore an alarm is triggered in four cases, specifically firstly when no clear code is received, secondly when an alarm code is received, thirdly when the security element 14 is severed and fourthly when the casing and hence the switch 29 is opened.

In the above description, various assemblies of the device according to the invention were described in various combinations. The individual combinations of the single assemblies are however also part of the inventive idea or are claimed in themselves as essential features of the invention. This applies in particular to the various coding measures and the arrangement of the timing circuit 40 to save power.

I claim:

1. In a device for the monitoring of objects and/or persons, in conjunction with an RF transmitter, and being in the form of a security tag with a casing accommodating an electronic circuit which comprises a battery and an alarm circuit, and which further comprises on the one hand an electrically conducting security element for attaching the security tag to the object/the person which triggers an alarm if severed, and which comprises on the other hand an RF receiver for alternative triggering of an alarm in response to an external RF field generated by the RF transmitter; the improvement wherein the electronic circuit further comprises an alarm circuit (30) and a decoder (20) which outputs an alarm signal to the alarm circuit (30) to trigger an alarm when a defined information content of a coded RF signal from an RF transmitter is present;

wherein the decoder (20) and the alarm circuit (30) are designed in such a manner that when a first alarm code is received the alarm is triggered, and when a second reset code is received a triggered alarm is switched off; and wherein the decoder (20) comprises a suppression circuit (30) which then outputs an alarm signal to the alarm circuit (30) if the second reset code is not received.

2. Device according to claim 1 characterized in that the decoder (20) comprises means (23, 23') of setting a code.

3. Device according to claim 2, characterized in that the means of setting both codes comprises a single coding switch (23) by means of which both the codes can be set simultaneously.

4. Device according to claim 3 characterized in that the electronic circuit (20) comprises a divider (25), via which the alarm signal is led in such a manner that an alarm is triggered only if a number of alarm signals corresponding to a division ratio of the divider (25) were received.

5. Device according to claim 1 characterized in that the electronic circuit comprises a switch (29) which is mechanically connected to the casing in such a manner that its switch state alters when the casing is opened and an alarm signal is passed to the alarm circuit (30).

6. Device according to claim 5 characterized in that the electronic circuit comprises a first pull-up resistor (27) between a first end of the security element (14) and a switch point (B; Vcc) with a defined first logical level ("1"), whereby the second end of the security element (14) lies on a logical level ("0") opposite to that of the first logical level.

7. Device according to claim 6, characterized in that the electronic circuit further comprises a second pull-up resistor (28) electrically connected between said switch (29) and said switch point (B; Vcc).

8. Device according to claim 5 characterized in that the electronic circuit comprises an OR gate (24) to the input of which all alarm signals are led and the output of which is connected to an alarm set input of the alarm circuit (30).

9. Device according to claim 8 characterized in that the electronic circuit comprises a timing circuit (40) which outputs at defined intervals switch-on signals to controllable switches (43, 44) between the battery (45) and power supply connections (Vcc) of power-consuming components (27, 28) or assemblies (19, 20, 24, 26) to sample the alarm states.

10. Device according to claim 9, characterized in that the timing circuit (40) is designed in such a manner that the decoder (20) and (if appropriate) the OR gate (24) are supplied with power only for a period of time sufficient to receive the defined information content.

11. Device according to one of the claims 9 or 10, characterized in that the power-consuming components (27, 28) or assemblies (26) provided in the electronic circuit for monitoring the security elements (14) and the switch (29) are supplied with power only during a period of time defined at least by the switch times of the electronic circuit.

12. Device according to claim 11, characterized in that the timing circuit (40) has a clock output (C1) led to clock inputs of the electronic circuit and lies with a control input via a synchronization circuit (19) at the output of the RF receiver for synchronization of clock pulses.

13. Device according to claim 9, characterized in that the suppression circuit comprises a counter (39) which is continuously supplied with power, a counting input (Count) of which is connected to the timing circuit (40) for counting the defined intervals, a reset input (Res) of which is connected to the decoder (20) for resetting when the second code is received and the output of which is connected to the alarm circuit (30) for outputting an alarm signal when the counter (39) exceeds the limit.

14. Device according to claim 13 characterized in that the alarm circuit (30) comprises an electroacoustic transducer to output an acoustic alarm.

15. Device according to claim 13 characterized in that the alarm circuit (30) comprises an RF alarm transmitter (34) to output an alarm signal detectable by an RF receiver.

16. Device according to claim 13 characterized in that the alarm circuit (30) comprises coding means (35) for coding the alarm signal.

17. Device according to claim 13 characterized in that an aerial input of the electronic circuit is connected to an aerial (17) which is led together with the security element (14) out of the casing.

18. Device according to claim 17, characterized in that the security element (14) forms the one core or the inner conductor of a two-core lead or a coaxial cable, the other core or outer conductor of which forms the aerial (17).

19. Device according to one of claims 17 or 18, characterized in that the security element (14) is led at one end via an inductor (18) to chassis.

20. Device according to claim 5 characterized in that the alarm circuit (30) comprises an alarm memory (31) which is designed in such a manner that an alarm sounds at least for a defined period of time when an alarm signal is output.

21. Device according to claim 20, characterized in that the alarm memory (31) can be cleared by means of a reset signal.

22. Device according to claim 1, characterized in that the suppression circuit comprises a counter (39) which is continuously supplied with power, a counting input (Count) of which is connected to the timing circuit (40) for counting the defined intervals, a reset input (Res) of which is connected to the decoder (20) for resetting when the second code is received and the output of which is connected to the alarm circuit (30) for outputting an alarm signal when the counter (39) exceeds the limit.

23. Device according to claim 22, characterized in that the alarm circuit (30) comprises an electroacoustic transducer to output an acoustic alarm.

24. Device according to claim 22, characterized in that the alarm circuit (30) comprises an RF alarm transmitter (34) to output an alarm signal detectable by an RF receiver.

25. Device according to claim 22, characterized in that the alarm circuit (30) comprises coding means (35) for coding the alarm signal.

26. Device according to claim 22, characterized in that an aerial input of the electronic circuit is connected to an aerial (17) which is led together with the security element (14) out of the casing.

27. Device according to claim 26, characterized in that the security element (14) forms the one core or the inner conductor of a two-core lead or a coaxial cable, the other core or outer conductor of which forms the aerial (17).

28. Device according to claims 26 or 27, characterized in that the security element (14) is led at one end via an inductor (18) to chassis.

29. In a device for the monitoring of objects and/or persons, in conjunction with an RF transmitter, and being in the form of a security tag with a casing accommodating an electronic circuit which comprises a battery and an alarm circuit, and which further comprises on the one hand an electrically conducting security element for attaching the security tag to the object/the person which triggers an alarm if severed, and which comprises on the other hand an RF receiver for alternative triggering of an alarm in response to an external RF field generated by the RF transmitter; the improvement wherein the electronic circuit further comprises an alarm circuit (30) and a decoder (20) which outputs an alarm signal to the alarm circuit (30) to trigger an alarm when a defined information content of a coded RF signal from an RF transmitter is present; and wherein the electronic circuit comprises a timing circuit (40) which outputs at defined intervals switch-on signals to controllable switches (43, 44) between the battery (45) and the power supply connections (Vcc) of power-consuming components (27, 28) or assemblies (19, 20, 24, 26) to sample the alarm states.

30. Device, according to claims 1 or 29, in combination with a stationary RF transmitter emitting the coded RF signal.

31. Device according to claim 29, characterized in that the decoder (20) comprises means (23, 23') of setting a code.

32. Device according to claim 31, characterized in that the means of setting both codes comprises a single coding switch (23) by means of which both the codes can be set simultaneously.

33. Device according to claim 32, characterized in that the electronic circuit (20) comprises a divider (25), via which the alarm signal is led in such a manner that an alarm is triggered only if a number of alarm signals corresponding to a division ratio of the divider (25) were received.

34. Device according to claim 29, characterized in that the electronic circuit comprises a switch (29) which is mechanically connected to the casing in such a manner that its switch state alters when the casing is opened and an alarm signal is passed to the alarm circuit (30).

35. Device according to claim 34, characterized in that the electronic circuit comprises a first pull-up resistor (27) between a first end of the security element (14) and a switch point (B; Vcc) with a defined first logical level ("1"), whereby the second end of the security element (14) lies on a logical level ("0") opposite to that of the first logical level.

36. Device according to claim 35, characterized in that the electronic circuit further comprises a second pull-up resistor (28) electrically connected between said switch (29) and said switch point (B; Vcc).

37. Device according to claim 34, characterized in that the electronic circuit comprises an OR gate (24) to the input of which all alarm signals are led and the output of which is connected to an alarm set input of the alarm circuit (30).

38. Device according to claim 34, characterized in that the alarm circuit (30) comprises an alarm memory (31) which is designed in such a manner that an alarm sounds at least for a defined period of time when an alarm signal is output.

39. Device according to claim 38, characterized in that the alarm memory (31) can be cleared by means of a reset signal.

40. Device according to claim 29, characterized in that the timing cicuit (40) is designed in such a manner that the decoder (20) and (if appropriate) the OR gate (24) are supplied with power only for a period of time sufficient to receive the defined information content.

41. Device according to claims 1 or 40 characterized in that the power-consuming components (27, 28) or assemblies (26) provided in the electronic circuit for monitoring the security elements (14) and the switch (29) are supplied with power only during a period of time defined at least by the switch times of the electronic circuit.

42. Device according to claim 41, characterized in that the timing circuit (40) has a clock output (C1) led to clock inputs of the electronic circuit and lies with a control input via a synchronization circuit (19) at the output of the RF receiver for synchronization of clock pulses.

* * * * *